US011174706B2

(12) United States Patent
Hay et al.

(10) Patent No.: US 11,174,706 B2
(45) Date of Patent: Nov. 16, 2021

(54) PIPE IN PIPE DOWNHOLE ELECTRIC HEATER

(75) Inventors: Richard Thomas Hay, Spring, TX (US); Clive Menezes, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 878 days.

(21) Appl. No.: 14/370,671

(22) PCT Filed: Jan. 11, 2012

(86) PCT No.: PCT/US2012/020917

§ 371 (c)(1),
(2), (4) Date: Jul. 3, 2014

(87) PCT Pub. No.: WO2013/105951

PCT Pub. Date: Jul. 18, 2013

(65) Prior Publication Data

US 2014/0326504 A1 Nov. 6, 2014

(51) Int. Cl.
*E21B 36/00* (2006.01)
*E21B 36/04* (2006.01)

(52) U.S. Cl.
CPC ..... *E21B 36/04* (2013.01); *E21B 36/003* (2013.01)

(58) Field of Classification Search
CPC ..... E21B 36/00; E21B 36/005; E21B 36/04; E21B 36/006; F24H 1/10; F24H 1/18; F24H 1/185
USPC ..... 392/301, 302, 478, 466, 465
See application file for complete search history.

(56) References Cited

U.S. PATENT DOCUMENTS 2,911,047 A * 11/1959 Henderson ..... E21B 36/006 166/61
3,617,699 A * 11/1971 Othmer ..... F16L 53/004 137/341
3,626,987 A * 12/1971 Bittner ..... F16L 59/14 138/114
4,026,273 A * 5/1977 Parker ..... F24J 2/07 126/646
4,370,944 A * 2/1983 Nagata ..... B05B 7/066 118/302
4,408,117 A * 10/1983 Yurkanin ..... F24H 1/185 174/111
4,980,133 A * 12/1990 Koch ..... C30B 11/003 117/201
5,853,031 A * 12/1998 de Oliveira ..... F16L 53/32 138/149
6,031,972 A * 2/2000 Barker ..... F24H 1/105 138/33
6,739,803 B2 * 5/2004 Bass ..... F16L 1/16 405/169

(Continued)

OTHER PUBLICATIONS

International Search Report and Written Opinion issued in related International Application No. PCT/US2012/020917 dated Sep. 6, 2012, 9 pages.

*Primary Examiner* — Robert J Utama
*Assistant Examiner* — Ayub A Maye
(74) *Attorney, Agent, or Firm* — Benjamin Ford; Baker Botts L.L.P.

(57) ABSTRACT

A pipe in pipe electric heater assembly comprising a work string comprising an inner pipe and an outer pipe and a heater element, wherein the heater element is provided with power supplied by the inner pipe and the outer pipe acting at least as conductors and associated methods.

20 Claims, 7 Drawing Sheets

(56) References Cited

U.S. PATENT DOCUMENTS

| | | | | |
|---|---|---|---|---|
| 6,955,221 | B2 * | 10/2005 | Bursaux | E21B 36/005 166/303 |
| 9,631,839 | B2 * | 4/2017 | O'Rourke | F24J 2/4632 |
| 2001/0050110 | A1 * | 12/2001 | Born | F16L 59/14 138/111 |
| 2007/0187089 | A1 | 8/2007 | Bridges | |
| 2009/0107558 | A1 * | 4/2009 | Quigley | F16L 11/12 137/15.01 |
| 2009/0200023 | A1 | 8/2009 | Costello et al. | |
| 2011/0134958 | A1 | 6/2011 | Arora et al. | |
| 2012/0124969 | A1 * | 5/2012 | Nagasawa | B03C 3/363 60/274 |

* cited by examiner

PIPE IN PIPE DOWNHOLE ELECTRIC HEATER

CROSS-REFERENCE TO RELATED APPLICATION

This application is a U.S. National Stage Application of International Application No. PCT/US2012/020917 filed Jan. 11, 2012, which is hereby incorporated by reference in its entirety.

BACKGROUND

To produce hydrocarbons (e.g., oil, gas, etc.) from a subterranean formation, wellbores may be drilled that penetrate hydrocarbon-containing portions of the subterranean formation. For offshore subterranean formations, the wellbores may be drilled from the sea surface by the use of a riser. A riser is a conduit that provides a temporary extension of a subsea oil well to a surface drilling facility.

In deep water drilling, the risers may reach lengths in excess of 10,000 feet. When pumping drilling fluid down the drill pipe inside a riser, the drilling fluid may be cooled by heat exchange with the surrounding sea water and the returning upward flowing fluid and cuttings from the bore hole between the sea water surrounding the riser and the downward flowing drilling fluid inside the drill pipe that is inside the riser. When the downward flowing cooled fluid reaches the bit the chances of creating fractures in the rock of the bore hole wall may increase. This may be due to the shrinking or contraction of the formation rock. In some instances, cracks may form that are so large that dramatic loss of drilling fluid occurs into the formation and/or bore hole stability issues occur that could cause the bore hole to collapse.

Other forms of riserless assemblies, where it is optional to maintain a segregated fluid column in a pipe from the well head on the sea floor to the rig on the water surface such as is the case with Reelwell's drilling system, make use of an inner pipe inside the drill pipe to return cuttings and drilling fluid to the surface and downward flowing drilling fluid between the inner pipe and outer drill pipe or similar conventions using nested coil tubing strings. Such configurations are also useful in work strings for various completions, stimulation or work over operations. As with risers the downward flowing mud is exposed to heat exchange with the sea water through the wall of the outer pipe resulting in cold mud reaching the sub sea well head which continues downward toward the end of the drill string and exits the drill bit exposing the bore hole to drilling fluid having a lower temperature than the formation.

Previous attempts to heat the drilling fluid down hole using fluid friction devices have proven marginal at best and prone to high operating costs due to wear and impinges the available hydraulic pressure required for normal drilling operations. It is therefore desirable to provide a reliable method of heating the drilling fluid downhole.

BRIEF DESCRIPTION OF THE DRAWINGS

Some specific example embodiments of the disclosure may be understood by referring, in part, to the following description and the accompanying drawings.

Figure 1:
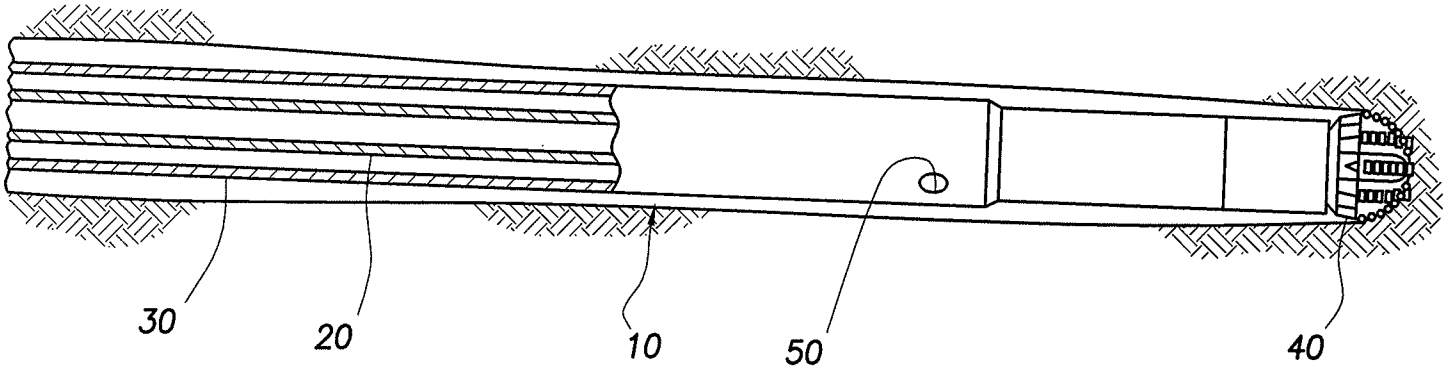
FIG. 1 illustrates an existing drilling system.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time-consuming, but would nevertheless be a routine undertaking for those of ordinary skill in the art having the benefit of the present disclosure.

In one embodiment, the present disclosure provides a pipe in pipe electric heater assembly comprising a work string comprising an inner pipe and an outer pipe and a heater element, wherein the heater element is provided with power supplied by the inner pipe and the outer pipe acting at least as conductors.

In another embodiment, the present disclosure provides a method of providing power to a heater element comprising providing a pipe in pipe electric heater assembly comprising a work string comprising an inner pipe and an outer pipe and a heater element, wherein the heater element is provided with power supplied by the inner pipe and the outer pipe acting at least as conductors and providing power to the heater element.

In another embodiment, the present disclosure provides a method of heating a fluid comprising providing a pipe in pipe electric heater assembly comprising a work string comprising an inner pipe and an outer pipe and a heater element, wherein the heater element is provided with power supplied by the inner pipe and the outer pipe acting at least as conductors; flowing a fluid through an annulus formed by the inner pipe and the outer pipe; and providing power to the heater element to heat the fluid.

To facilitate a better understanding of the present invention, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells as well as production wells, including hydrocarbon wells.

The terms "couple" or "couples," as used herein are intended to mean either an indirect or direct connection. Thus, if a first device couples to a second device, that connection may be through a direct connection, or through an indirect electrical connection via other devices and connections. The term "uphole" as used herein means along the drillstring or the hole from the distal end towards the surface, and "downhole" as used herein means along the drillstring or the hole from the surface towards the distal end.

It will be understood that the term "oil well drilling equipment" or "oil well drilling system" is not intended to limit the use of the equipment and processes described with those terms to drilling an oil well. The terms also encompass drilling natural gas wells or hydrocarbon wells in general. Further, such wells can be used for production, monitoring, or injection in relation to the recovery of hydrocarbons or other materials from the subsurface. Such wells could also be considered for geothermal energy production or injection of water to create steam in return wells.

The present invention relates generally to well drilling and completion operations and, more particularly, to systems and methods for heating drilling, stimulation, work over or completion fluids downhole.

Referring now to FIG. 1, FIG. 1 depicts an existing drilling system (10) comprising a small returns pipe (20) within a larger downward fluid flow pipe (30) and a bottom hole assembly (40). In drilling system (10), drilling fluid may be pumped down to the bottom hole assembly (40) through the downward fluid flow pipe (30) and then the drilling fluid and cuttings may be transported back to the surface inside the small returns pipe (20) through a diverter port (50).

Figure 2:
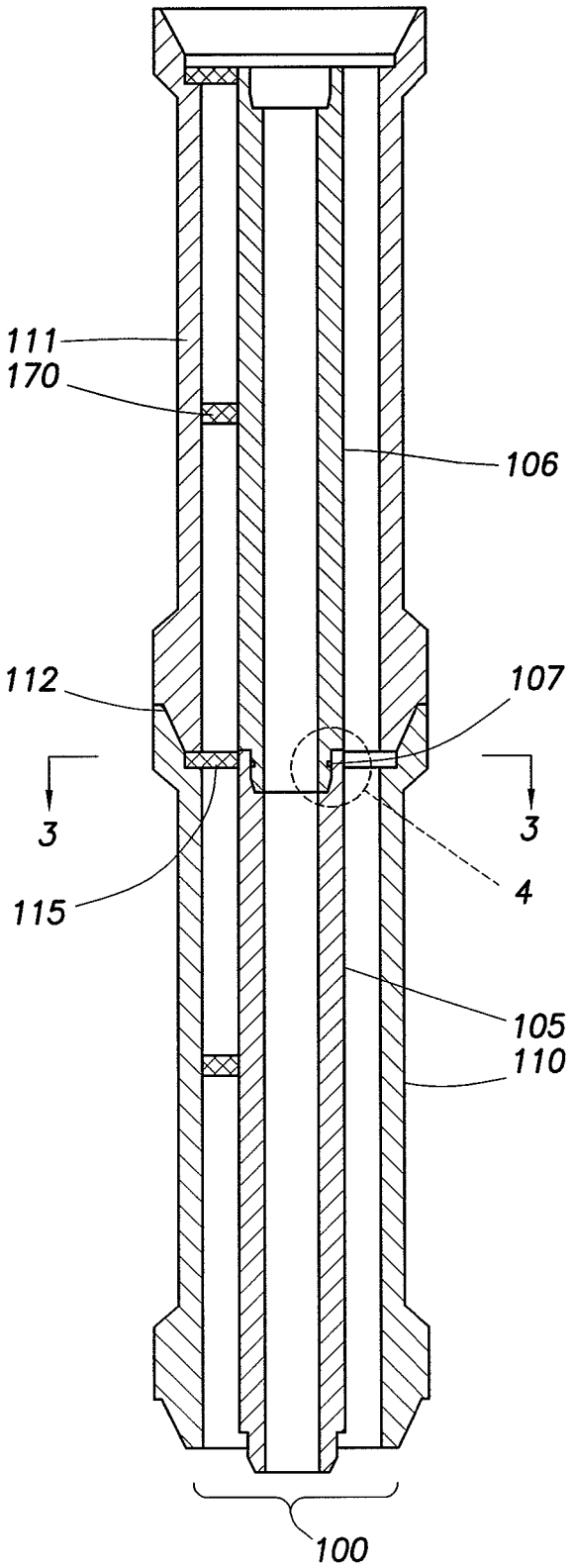
FIG. 2 illustrates an example configuration of a work string according to aspects of the present disclosure.

Referring now to FIG. 2, dual work string section (100) (simplified for ease of understanding) may include an inner pipe (105) and an outer pipe (110). Inner pipe (105) may comprise one or more inner pipe sub sections (106) which may be coupled together at one or more inner pipe joint connections (107). Outer pipe (110) may comprise or more outer pipe sub sections (111) which may be coupled together at one or more outer pipe joint connections (112). Drilling fluid may be pumped downhole through an annulus formed by outer pipe (110) and inner pipe (105) and be returned uphole within inner pipe (105). In certain embodiments, before the drilling fluid is returned uphole within inner pipe (105), it may be diverted through a bottom hole assembly and out the drill bit, then travel along the outside of the bottom hole assembly, and then back into the inner pipe through a flow diverter.

Inner pipe (105) and outer pipe (110) may be eccentric or concentric pipes. Inner pipe (105) and outer pipe (110) may be constructed out of any type of electrically conductive materials. Suitable materials may include alloy steel, non-magnetic austenitic stainless steel, aluminum pipe, beryllium copper, and non-conductive composite pipe with electrical conductor wires or conductive sleeves, metal strips or braided wire imbedded within the wall of the pipe or attached to the pipe. In certain embodiments, outer pipe (110) may comprise of casing, liner or a drill pipe. In certain embodiments, inner pipe (105) may comprise a drill pipe. In certain embodiments, at least one of the two pipes has the outer surface and/or the inner surface of pipe coated with an insulating material, which preferably would be the inner pipe (105). In some embodiments, the insulating material may be a dielectric material. Suitable examples of dielectric materials may include polyimide, a GORE™ high strength toughened fluoropolymer, nylon, TEFLON™, and ceramic coatings. In certain embodiments, preferably the inner pipe (105) may be coated with a dielectric material to an extent where inner pipe (105) is electrically insulated from outer pipe (110).

Figure 3:
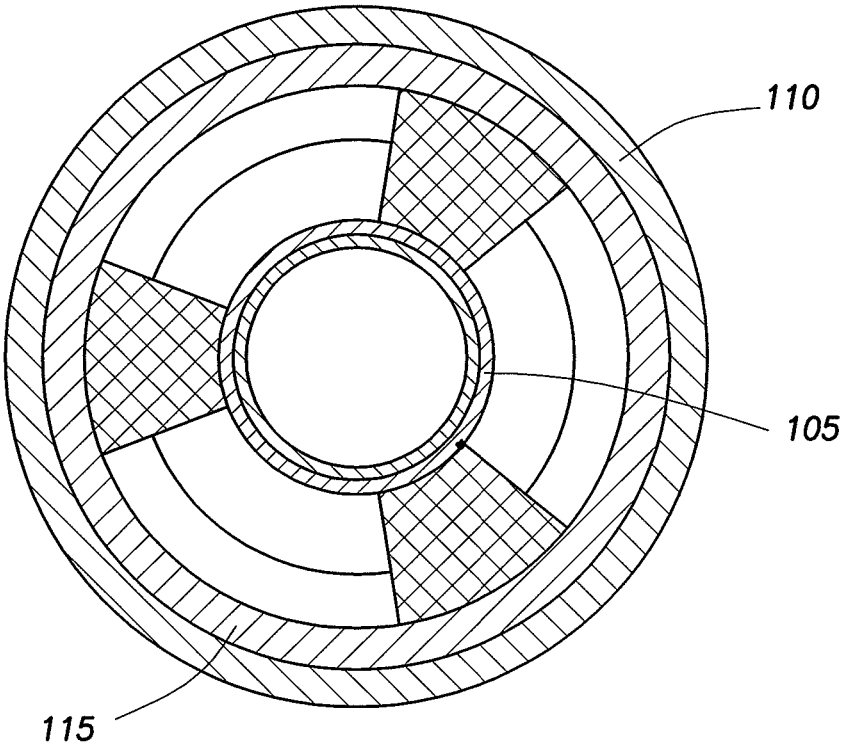
FIG. 3 illustrates an example configuration of a work string according to aspects of the present disclosure.

Dual work string section (100) may further comprise one or more hang off rings (115). In certain embodiments, inner pipe (105) may be hung off in single joint segments ideally to make handling easier. In certain embodiments, hang off rings (115) may be insulated hang off rings. Hang off rings (115) may hang off each inner shoulder of outer pipe (110). Referring now to FIG. 3, FIG. 3 is top view illustration of dual work string section (100) at an inner pipe joint connection (112). As can be seen in FIG. 3, hang off ring (115) may be positioned in the annulus between inner pipe (105) and outer pipe (110).

Figure 4:
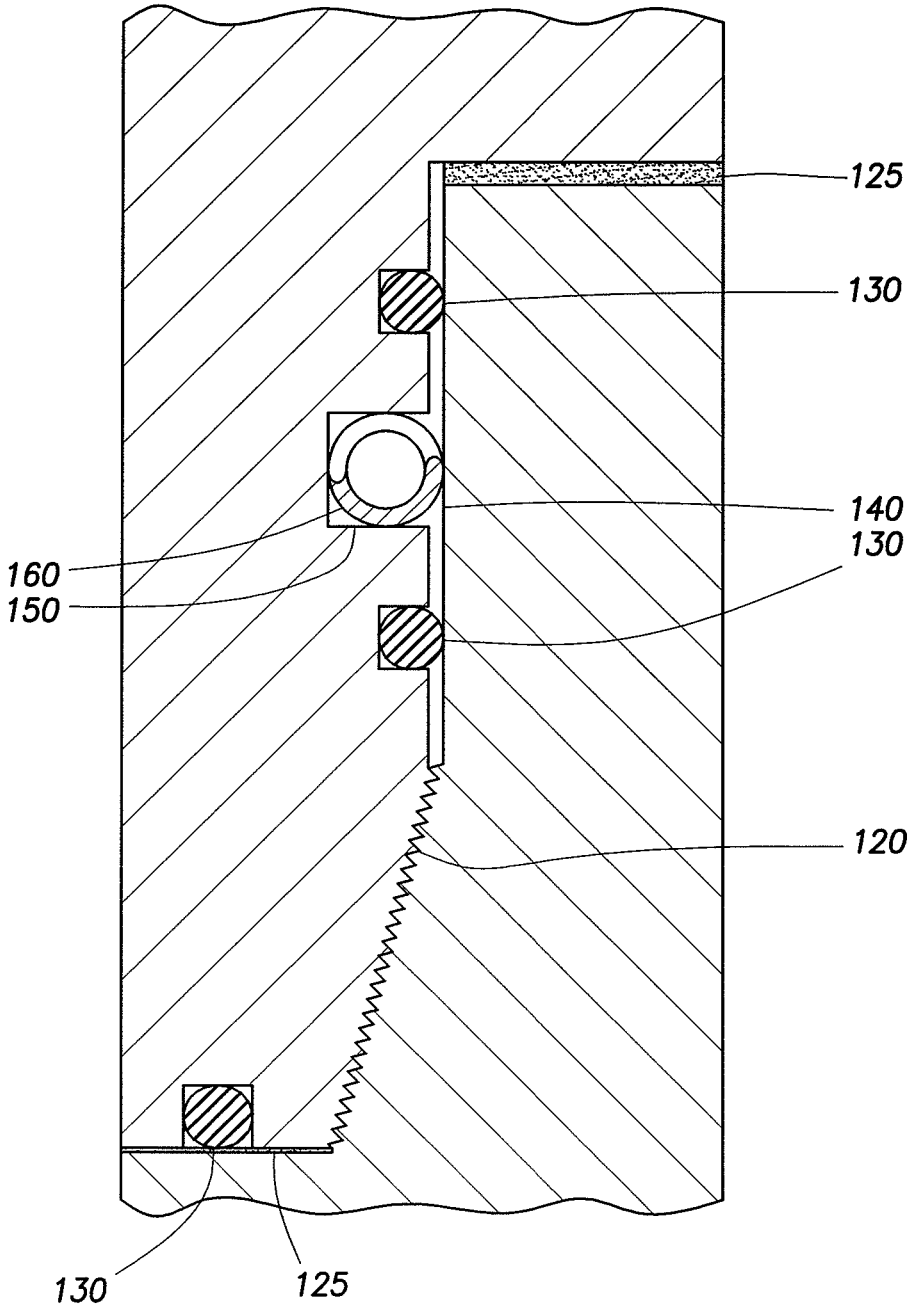
FIG. 4 illustrates an example configuration of an inner pipe joint connection according to aspects of the present disclosure.

Referring now to FIG. 4, FIG. 4 is a call out of inner pipe joint connection (107). In certain embodiments, inner pipe joint connection (107) may comprise one or more shoulder faces (120), one or more insulated coated surfaces (125), one or more seals (130), sealed electrical contact area (140), groove (150), and spring ring (160).

In certain embodiments, one or more shoulder faces (120) may be coated with an insulating material. Suitable insulating materials may include may include polyimide, a GORE™ high strength toughened fluoropolymer, nylon, TEFLON™, and ceramic coatings or a plurality of coatings. In other embodiments, one or more insulated coated surfaces (125) may provide the electrical insulation for the one or more shoulder faces (120). In certain embodiments, insulating coated surfaces (125) may comprise rubber insulating disks. Sealed electrical contact area (140) may be coated with a corrosion resistant material that enhances electrical continuity. Suitable examples of corrosion resistant materials include optional nickel layer and then gold over coating layer over the parent conductive pipe material. Other suitable examples include stainless steel, MONEL™, beryllium copper, or other like materials as the parent conductive pipe material that are corrosion resistant in of itself. The corrosion resistance is preferred to encourage good electrical continuity between the two connecting inner pipes. In certain embodiments, electrical contact may be maintained at several points in the sealed electrical contact area (140). Furthermore, in certain embodiments, spring ring (160), which may be located within groove (150), may provide an electrical contact. In certain embodiments, the only electrical contact is through sealed electrical contact area (140) or threads if used.

In certain embodiments, inner pipe (105) may be threaded to ensure contact above or below the sealed electrical contact area (140). In such cases the axial position of the hang off ring is adjusted such that it rests on inner shoulder of the outer pipe or allowed to float over a short interval of the inner pipe so as not to interfere with the outer pipe connection make up. In other embodiments, inner pipe (105) may be a simple stab in without a thread or a slight interference fit especially if gas tight seal is desired where a nipple and socket compress together to form a mechanical sealing arrangement. It is desirable to ensure electrical contact between inner pipe sub sections (106) while preventing a short circuit to outer pipe (110) if it is utilized as the second electrical path for the electrical current flow.

Figure 5:
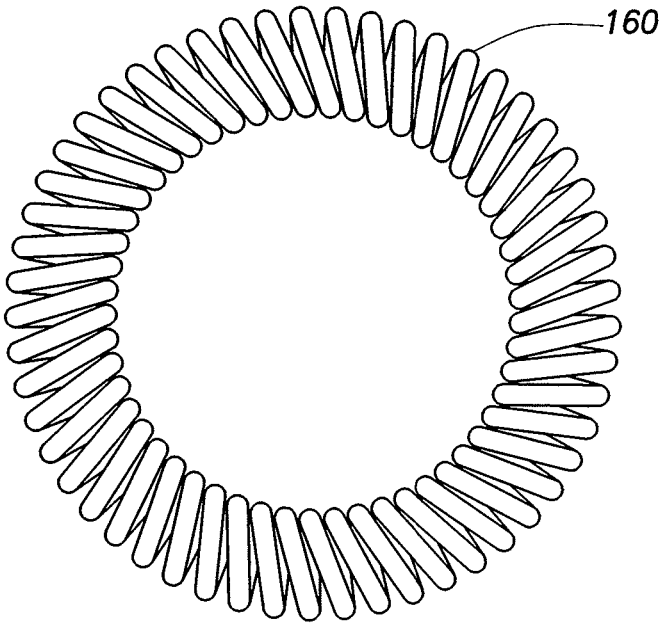
FIG. 5 illustrates an example configuration of a spring ring according to aspects of the present disclosure.

Referring now to FIG. 5, FIG. 5 illustrates an embodiment of spring ring (160). In certain embodiments, spring ring (160) may be a typical spring ring. Examples of suitable spiral springs include those manufactured by Bal Seal Engineering. Other styles of springs can be used or any means to ensure metal to metal contact to effect electrical conduction.

Referring back to FIG. 2, dual work string section (100) may further comprise one or more heating modules (170). In certain embodiments, heating module (170) may comprise a heating element and optionally a temperature sensor. In certain embodiments, the heating element may be a nicrom wire or any other suitable resistive element that generates heat when electric current is passed through it. Once the dual work string section (100) is set up, electrical power can be applied between the electrically conductive inner pipe (105) and outer pipe (110) and power may propagate over the length of the dual work string section (100). On the surface a swivel with a slip ring may used to connect power to inner pipe (105) and outer pipe (110). A terminator on the dual work string section (100) may be used to reduce any short circuit loses through the mud to outer pipe (110) by dead ending the electrical conduction of inner pipe (105). Other devices such as a shrink sleeve may be used. At specific locations heating elements may be switched on that generates electrically resistive heat by passing electric current between the inner pipe (105) and outer pipe (110).

Ideally heating elements may be distributed along the length of dual work string section (100) to inject heat into the downward flowing fluid in the string, in most cases fluid in the annular space between inner pipe (105) and outer pipe (110). In other embodiments the inner fluid travelling upward can be heated which then heats the downward flowing fluid through heat conduction of the inner pipe. In one embodiment the heating elements may be placed along the entire outer surface of inner pipe (105) and may be selectively turned on and off to ensure uniform heating of the fluids in the dual work string section (100) to ensure a uniform temperature. In other embodiments, dual work string section (100) may be fitted with suitable thermocouples or temperature sensors to maintain switching the heating elements on and off. Examples of suitable thermocouples or temperature sensors include J, K, T, E, R, and S class thermocouple probes with T class being the most suitable, other electronic temperature sensors mounted on circuit board such as thermo resistors, or a TMP36GRTZ made by Analog Devices. Fluid shear can also generate heat as is detailed in U.S. Pat. No. 7,467,658, which can be adapted to shear the flowing fluid between the inner pipe (105) and outer pipe (110). Other methods may include electric motor driven friction plates rotating against each other to create heat.

It is further noted that temperature sensors may be located in other positions along dual work string section (100) and do not necessarily have to be located within the heater modules (170). The entire dual work string section (100) may have networked heaters capable of sending and receiving data and commands with other downhole modules, including the heater modules (170) or control modules and surface monitor and control modules. Each heater module (170) may be given a specific network address for communicating with it or a grouping of heater modules (170) may be ganged together with the same address to behave like one larger module in unison or to allow for sub addresses within the groupings to communicate with and control one specific heater module (170). Other sensors, including drilling force sensors such as applied weight/pull, bending, bend direction, vibration, torque, rotation, accelerations, fluid viscosity, flow rate and formation evaluation sensors such as natural gamma ray, resistivity, density, porosity, and seismic receiver sensors.

Figure 6:
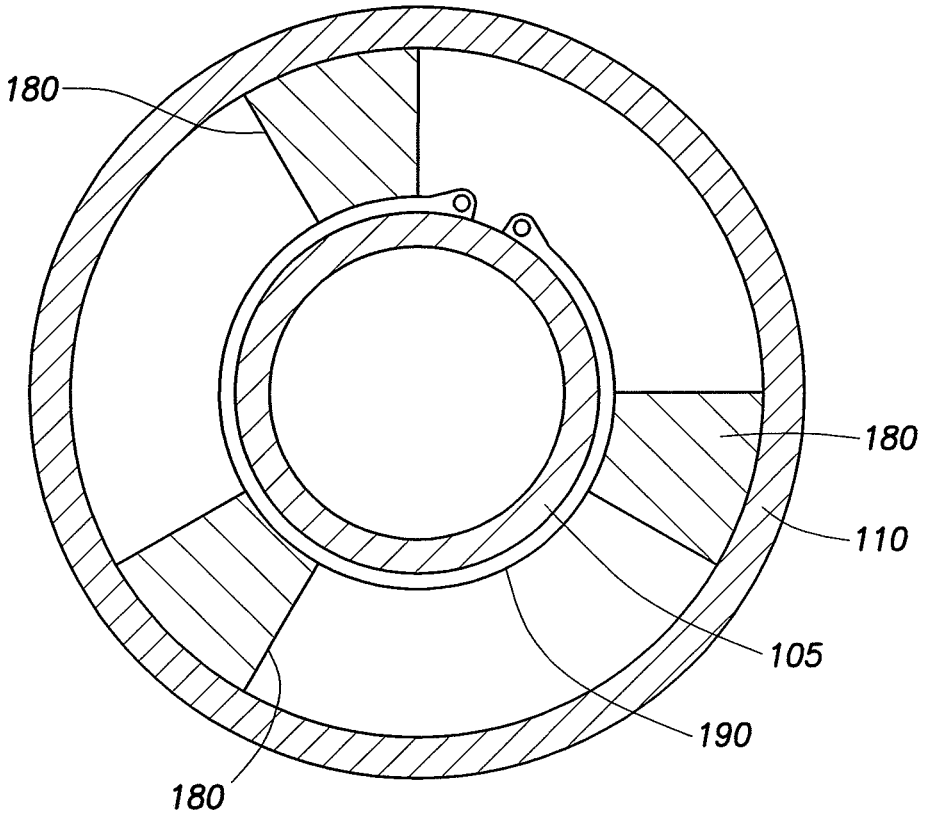
FIG. 6 illustrates an example configuration of a bottom view of a heating module in the work string according to aspects of the present disclosure.
Figure 7:
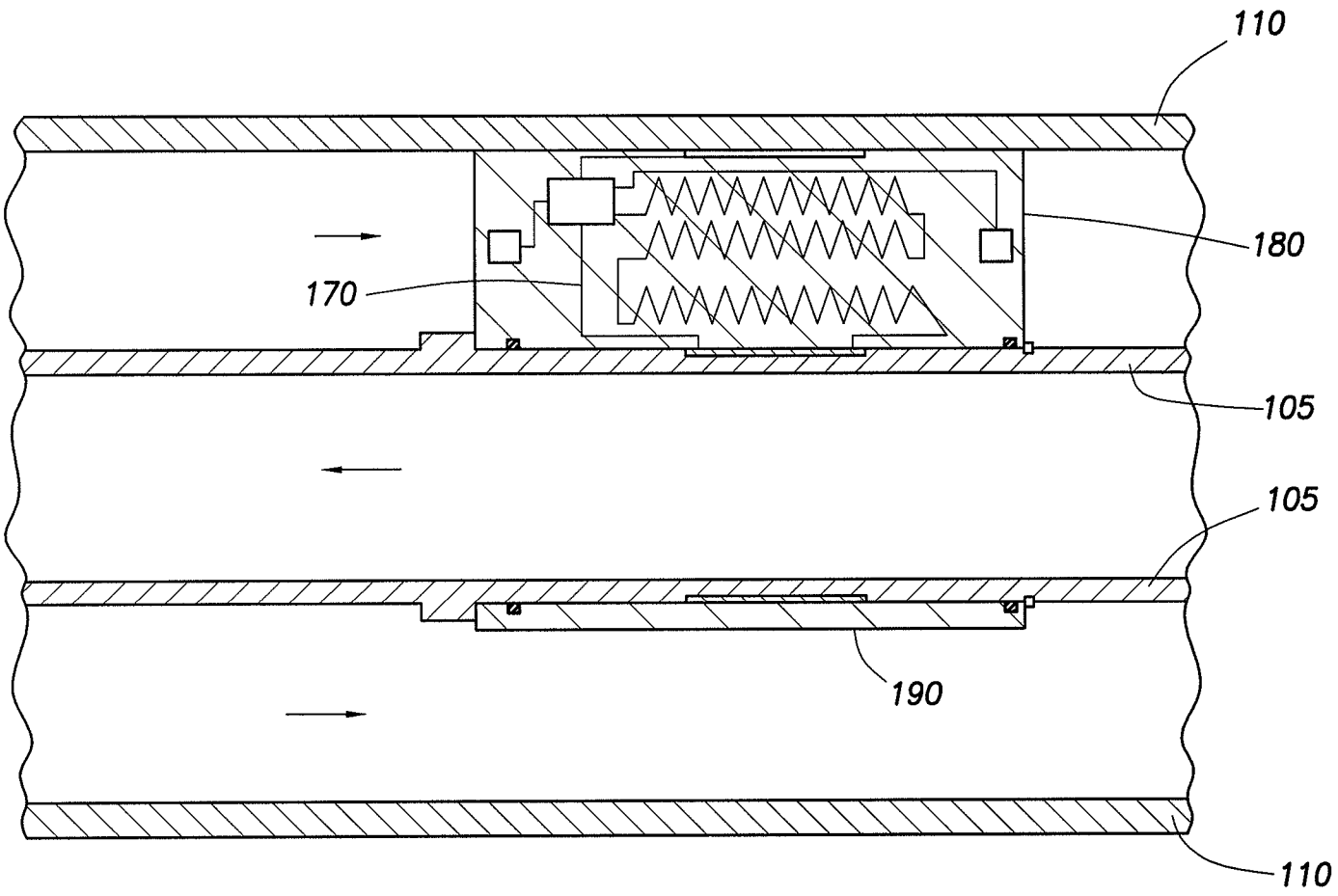
FIG. 7 illustrates an example configuration of a work string according to aspects of the present disclosure.

There are many ways to effect heat transfer into the fluid from the heater element. Referring now to FIG. 6 which is a bottom view of a heater assembly, shows a typical way one would be to mount ceramic or insulated metal heater ring with heater wedges (180), preferably at least 3 supports, and at least one wedge containing a heating element so the wedges (180) can double as a centralizer as shown in FIG. 6 allowing for a flow path between the outer ring and the inner pipe wall. Another way is demonstrated in FIG. 7. FIG. 7 shows a side view of dual work string section (100). As can be seen in FIG. 7, wedge (180) may be mounted on inner pipe (105) and held in place with a wedge snap ring (190). Alternatively, a threaded component may be used to cap the wedge (180) in place. As the downward flowing mud passes heater modules (170) the heating elements exchange heat with the mud. Temperature sensors mounted in the module maintain the temperature below damaging levels while aiding in the regulation of heat flow into the surrounding fluid. In certain embodiments, a controller may be integrated into the vane or wedge. Also, while not shown in the Figures, a controller can control heating elements in multiple vanes rather than just the single vane ideally though with by just wiring in the other heater elements in the other vanes in parallel or series with the heating control module. Preferably the control module is positioned upstream from the heating coils to avoid over heating of the controller electronics. The control electronics are contained in a sealed pressure cavity to protect it from the pressure exerted on the flowing mud. A mud temperature sensor is positioned downstream of the heating elements to monitor the effectiveness of the heat exchange from the heating elements into the flowing fluid. In addition an upstream fluid temperature sensor can optionally be included to monitor the temperature difference between the mud entering the heat exchange area and the mud exiting the heat exchange area. The controller and temperature sensors effectively are used as a thermostat, regulating the mud temperature to maintain it at a desired level along the work string. The upper temperature sensor which in the preferred embodiment monitors downward flowing fluid temperature can be used to assess the heat retention of the fluid from the heat injected into the fluid from a heater further up in the flow. The upper heater module can be relayed the data from the lower heater module over the communications network to aid in the determination of how much heat injection is required at the upper station given any temperature drop measured over the work string interval between the upper and lower heaters.

Figure 8:
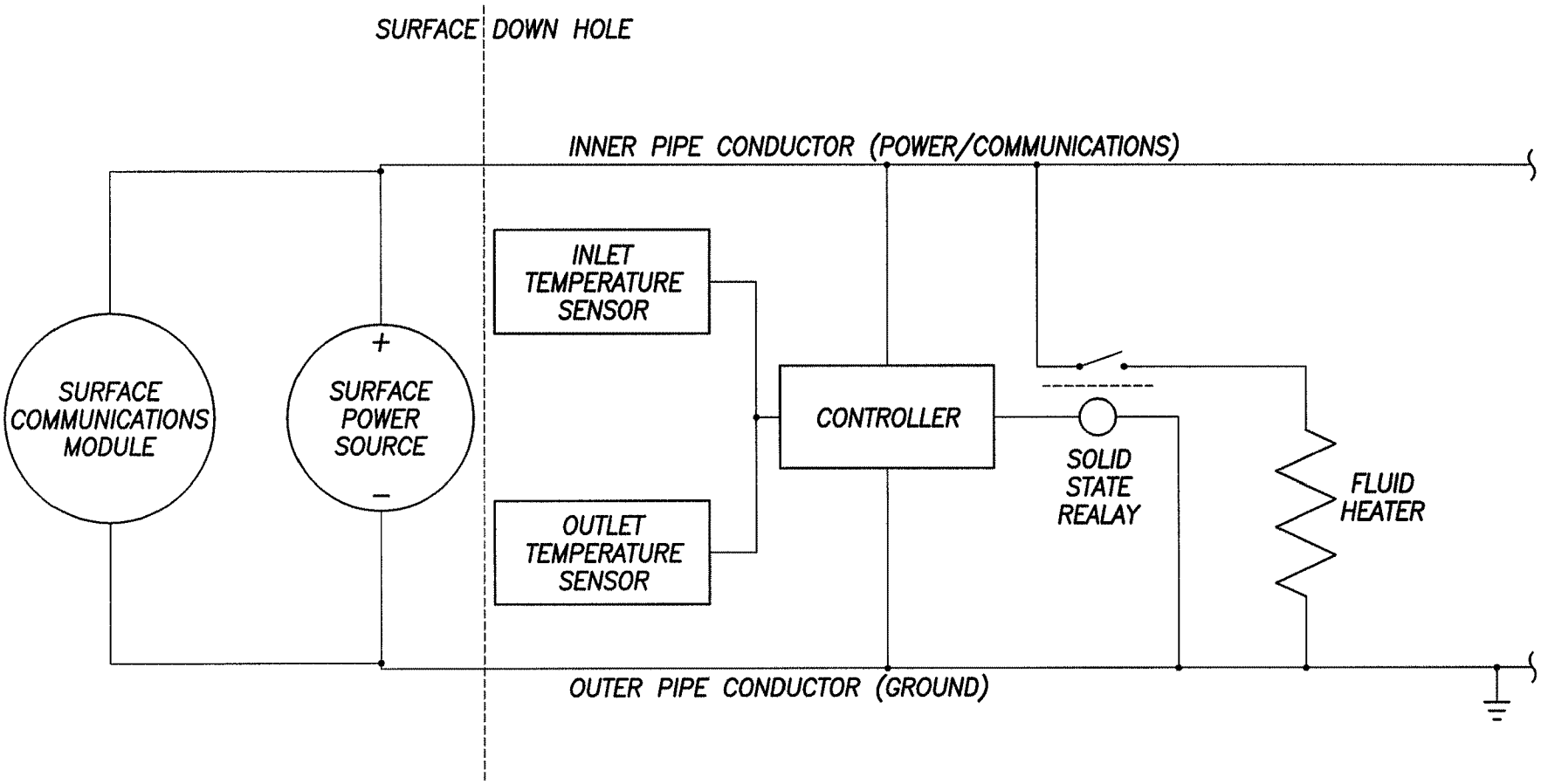
FIG. 8 illustrates an example heat controller schematic according to aspects of the present disclosure.

Referring now to FIG. 8, FIG. 8 illustrates a heat controller schematic. In certain embodiments, the heat controller system may be a bare bones system wired to be always on, thus supplying constant heat input into the fluid. However, in other embodiments, a thermostat may be used to regulate the heater so it does not switch on if the fluid temperature exceeds a pre-set threshold. In this manner a plurality of heater modules may be dispersed along the work string to inject heat into the fluid where the thermostat senses it is required. Ideally the controller module should be located upstream of the heater element to avoid accidental over heating of the controller module.

In other embodiments, an addressable controller over the communications network may establish bi-directional communications along the dual work string section using the inner pipe and outer pipe as a signal cable for transmitting data with the power over the dual work string section. A person skilled in the art is more than capable of developing various schemes for sharing power and communication over the same 2 conductors. Preferably direct current for power should be used rather than alternating current as the dielectric losses due to the conductivity of the fluid will attenuate the power transfer somewhat but AC power could be used with the data signal super imposed on the power signal. Alternately one could pick an ideal AC frequency that would maximize losses into the dialect which would create heat from those loses, thus negating or reducing the need for heating nodes down hole. It is well know to those skilled in the art that the dielectric loss in a coaxial cable is a function of frequency. The loss is directly related to the characteristic impedance of the fluid which flows in the annular space between the inner and outer pipe. The energy is dissipated into the mud in the form of heat as the power wave propagates along the drillstring.

Referring again to FIG. 8, the surface controller may receive inlet and outlet temperatures of each heater node on the dual work string section. In FIG. 8, just one node is shown. As a minimum the outlet temperature may need to be monitored, but if the inlet temperature is also monitored, then the duty cycle of the heater may be varied from 100% on to some value less than 100% per unit of time to on average inject the desired amounts of joules of energy into the fluid to heat it up or vary the amount of energy dissipated by the heating element by varying the applied voltage to the heating elements with the controller. This may allow the system to be more responsive to changes in fluid types and more specifically, variances in the specific heat of the fluid. Higher specific heat fluids such as oil based muds verses water based muds would require more heat energy per degree in temperature rise. For example the specific heat of water is 1 Btu/lb.° F. verses mineral oil which is 0.4 meaning it takes more that twice the BTU to raise oil 1° F. verses water. Other methods would be to vary a continuous power level to the heater element rather than using an on/off duty cycle or various combinations of heat injection modulation by varying the power to the heater element as needed.

In certain embodiments, the controller may calculate the specific heat of the fluid using the two temperature sensors and the flow rate. With this information the controller can self tune itself to determine the needed duty cycle to turn the heater on and off. The volume of fluid exposed to the heater can be calculated with geometry calculations depending on the shape of the heater and the flow space around the heater. For example it is known that the specific heat can be calculated by using the following formula:

$$[C] = \frac{\mathrm{J}}{\mathrm{kg}\cdot\mathrm{K}}$$

Where C is the specific heat value in Joules/kilogram Kelvin

Extrapolating this equation to a mass flow of mud across the heater one can calculate the specific heat of the mud by using the following equation $$C = \beta[t]\frac{q}{(T_o - T_i)\cdot Q\cdot\rho}$$

Where β[t] is the heat transfer function representing heat flow as a function of time, C is the specific heat (J/kg), q is the hat flow (J/s or W), Q is the flow rate ($m^3/s$), ρ is the mud density ($kg/m^3$), $T_o$ is the output temperature (° C. or K), and $T_i$ is the inlet temperature (° C. or K).

β[t] may be calculated using the following formula:

$$\beta[t]=1-e^{-kt}$$

Where k is the temperature equilibrium factor and t is time (s).

C may be calculated using the following formula:

$$C = (1 - e^{-kt})\frac{q}{(T_o - T_i)\cdot Q\cdot\rho}$$

Combining these equations, it becomes evident that there is a warm up period where there essentially develops a temperature equilibrium between the heating element temperature and the flowing mud temperature which can best be illustrated by and exponential decay relationship. Hence to calculate the heat capacity based upon measurements of the inlet and outlet temperatures of the mud one should wait a period of time for the heat flow to stabilize prior to taking the measurement and use the first equation which is time independent. A number of factors play into this but as one skilled in the art knows one could also use the equation to calculate the specific heat more quickly by using 2 points in time and applying the third equation to solve for C if k is unknown. This would minimize the amount of power needed to determine the specific heat by being able to perform the calculation during the warm up phase rather than waiting for the system to completely stabilize.

However, the preferred way is to simply let the outlet temperature change stabilize by turning on the heater, wait long enough for the fluid at the top temperature sensor to travel through the heater and arrive at the bottom (outlet) temperature sensor then begin taking several samples at reasonable intervals such as one sample per second, then when the temperature change measured falls below an acceptable threshold, such as 0.01° C. difference between then last 2 temperature difference measurements ($T_o$–$T_i$) then apply equation 1 assuming a value of 1 for β[t]. To be more correct one can match the fluid temperature with a time lag such that the $T_o$ measurement is taken after a fixed unit of time to correlate with that volume of fluid as located at the inlet temperature. However if the temperature has stabilized one can remove the time factor from the calculation since the process is continuously replicating. Hence equation 1 still holds as a valid approach.

Once the transfer rate of heat flow is known by the above procedure or from prior offset data or calculations the controller can determine how much power or duty cycle to apply to the flowing mud by utilizing a new equation.

Re-arranging the first equation to find the delta temperature, the following equation may be obtained:

$$q = \frac{C\cdot Q\cdot\rho}{(T_o - T_i)}$$

With this equation, the power needed to raise the flowing fluid temperature by the desired temperature change of (To−Ti) may be calculated.

In other embodiments, alternate heating may involve voltage limiters that limit the amount of power delivered to the fluid heating element. This is a more complex method but straight forward engineering to achieve. The solid state relay offers a more reliable means of switching the heat source on and off. While a mechanical relay or a variac can be used, it is difficult to get a mechanical relay or variac armature to work in a drilling environment so a solid state relay is preferred since it has no moving parts in its switching function. Such devices are common in power application such as a Teledyne S20DC100.

The present invention is therefore well-adapted to carry out the objects and attain the ends mentioned, as well as those that are inherent therein. While the invention has been depicted, described and is defined by references to examples of the invention, such a reference does not imply a limitation on the invention, and no such limitation is to be inferred. The invention is capable of considerable modification, alteration and equivalents in form and function, as will occur to those ordinarily skilled in the art having the benefit of this disclosure. The depicted and described examples are not exhaustive of the invention. Consequently, the invention is intended to be limited only by the spirit and scope of the appended claims, giving full cognizance to equivalents in all respects.

What is claimed is:

1. A pipe in pipe electric heater assembly comprising:

a first pipe comprising a first electrically conductive material, a second pipe comprising a second electrically conductive material, and a heater element that is separate from the first pipe and the second pipe, wherein the first pipe is disposed within the second pipe, forming an annulus between the first pipe and second pipe, wherein the annulus between the first pipe and the second pipe allows a fluid to be pumped downhole through the annulus and returned uphole within the first pipe, wherein the heater element is disposed in the annulus between the first pipe and the second pipe wherein the heater element is directly exposed to a fluid flow through the annulus, wherein the heater element is provided with power supplied by the first pipe and the second pipe acting at least as conductors, and wherein the power is applied between the first pipe and the second pipe such that an electrical current passes from the first pipe through the heater element to the second pipe or from the second pipe through the heater element to the first pipe to provide power to the heater element, and wherein the heater element is configured to generate heat at the heater element from the electrical current passing through the heater element.

2. The pipe in pipe electric heater assembly of claim 1, wherein at least one of the first pipe or the second pipe is coated with an insulating material.

3. The pipe in pipe electric heater assembly of claim 2, wherein the insulating material comprises a dielectric material.

4. The pipe in pipe electric heater assembly of claim 3, wherein the dielectric material comprises at least one material selected from the group consisting of a polyimide, a high strength toughened fluoropolymer, nylon, polytetrafluoroethylene, and a ceramic coating.

5. The pipe in pipe electric heater assembly of claim 1, further comprising a temperature sensor.

6. The pipe in pipe electric heater assembly of claim 1, wherein the heater element is mounted to at least one of an outer surface of the first pipe and an inner surface of the second pipe.

7. The pipe in pipe electric heater assembly of claim 1, wherein the heater element is coupled to the first pipe and the second pipe.

8. A method of providing power to a heater element comprising:

providing a pipe in pipe electric heater assembly comprising:

a first pipe comprising a first electrically conductive material, a second pipe comprising a second electrically conductive material, and a heater element that is separate from the first pipe and the second pipe, wherein the first pipe is disposed within the second pipe, forming an annulus between the first pipe and second pipe, wherein the annulus between the first pipe and the second pipe allows a fluid to be pumped downhole through the annulus and returned uphole within the first pipe, wherein the heater element is disposed in the annulus between the first pipe and the second pipe wherein the heater element is directly exposed to a fluid flow in the annulus, wherein the heater element is provided with power supplied by the first pipe and the second pipe acting at least as conductors, and wherein the power is applied between the first pipe and the second pipe such that an electrical current passes from the first pipe through the heater element to the second pipe or from the second pipe through the heater element to the first pipe to provide power to the heater element; and providing power to the heater element, wherein the heater element generates heat at the heater element from the electrical current passing through the heater element.

9. The method of claim 8, wherein at least one of the first pipe or the second pipe is coated with an insulating material.

10. The method of claim 9, wherein the insulating material comprises a dielectric material.

11. The method of claim 10, wherein the dielectric material comprises at least one material selected from the group consisting of a polyimide, a high strength toughened fluoropolymer, nylon, polytetrafluoroethylene, and a ceramic coating.

12. The method of claim 8, wherein the pipe in pipe electric heater assembly further comprises a temperature sensor.

13. The method of claim 8, wherein the heater element is mounted to at least one of an outer surface of the first pipe and an inner surface of the second pipe.

14. The method of claim 8, wherein the heater element is coupled to the first pipe and the second pipe.

15. A method of heating a fluid comprising:

providing a pipe in pipe electric heater assembly comprising:

a first pipe comprising a first electrically conductive material, a second pipe comprising a second electrically conductive material, and a heater element that is separate from the first pipe and the second pipe, wherein the first pipe is disposed within the second pipe, forming an annulus between the first pipe and second pipe, wherein the annulus between the first pipe and the second pipe allows a fluid to be pumped downhole through the annulus and returned uphole within the first pipe, wherein the heater element is disposed in the annulus between the first pipe and the second pipe wherein the heater element is directly exposed to a fluid flow in the annulus, wherein the heater element is provided with power supplied by the first pipe and the second pipe acting at least as conductors, and wherein the power is applied between the first pipe and the second pipe such that an electrical current passes from the first pipe through the heater element to the second pipe or from the second pipe through the heater element to the first pipe to provide power to the heater element;

flowing a fluid through the annulus between the first pipe and the second pipe; and providing power to the heater element to heat the fluid, wherein the heater element generates heat to heat the fluid at the heater element from the electrical current passing through the heater element.

16. The method of claim 15, wherein at least one of the first pipe or the second pipe is coated with an insulating material.

17. The method of claim 16, wherein the insulating material comprises a dielectric material.

18. The method of claim 17, wherein the dielectric material comprises at least one material selected from the group consisting of a polyimide, a high strength toughened fluoropolymer, nylon, polytetrafluoroethylene, and a ceramic coating.

19. The method of claim 15, wherein the heater element is mounted to at least one of an outer surface of the first pipe and an inner surface of the second pipe.

20. The method of claim 15, wherein the heater element is coupled to the first pipe and second pipe.

* * * * *